United States Patent [19]

Wilson

[11] Patent Number: 5,009,715

[45] Date of Patent: Apr. 23, 1991

[54] METHOD FOR PREVENTING DETERIORATION OF CONCRETE PIPE

[76] Inventor: R. E. Wilson, 678 Alderwood Dr., Newport Beach, Calif. 92660

[21] Appl. No.: 438,310

[22] Filed: Nov. 20, 1989

Related U.S. Application Data

[62] Division of Ser. No. 44,405, Apr. 30, 1987, Pat. No. 4,899,770.

[51] Int. Cl.[5] ..... B08B 3/02

[52] U.S. Cl. ..... 134/22.11; 134/22.12; 134/22.14; 134/24; 134/34; 134/166 C; 134/166 R

[58] Field of Search ..... 134/22.1, 22.11, 22.12, 134/22.14, 24, 34, 35, 41, 166, 167 R; 15/1^4.3

[56] References Cited

U.S. PATENT DOCUMENTS 3,535,161 10/1970 Gutrich ..... 134/24
4,508,577 4/1985 Conn et al. ..... 134/24

*Primary Examiner*—Asko Pal
*Attorney, Agent, or Firm*—Nis, Kurz, Bergert & Tamburro

[57] ABSTRACT

A method and apparatus for cleansing the upper interior surfaces of a concrete sewer conduit, the apparatus including the concrete sewer pipe and a plurality of spray nozzles spaced apart and adapted to be introduced into and disposed in and along a length of concrete sewer to enable continuous or intermittent spraying of the upper interior surface or, alternatively, to be permanently mounted along the length of the concrete sewer conduit when newly constructed.

23 Claims, 2 Drawing Sheets

METHOD FOR PREVENTING DETERIORATION OF CONCRETE PIPE

This application is a division of application Ser. No. 44,405, filed Apr. 30, 1987, now U.S. Pat. No. 4,299,770.

FIELD OF THE PRESENT INVENTION

The present invention relates to sewer cleaning systems, and more particularly to a method and apparatus for cleansing the upper interior surfaces of concrete sewer pipes or conduits, ordinarily not washed by the flow of sewerage in the pipes, to prevent the deterioration of such interior surfaces due to the build up of acid.

BACKGROUND OF THE PRESENT INVENTION

Conventional sewer systems which are utilized to service large metropolitan areas invariably employ concrete sewer lines from 8 inches to over 12 feet in diameter. These concrete sewer lines are installed below ground level at depths of about from 3 feet to over 30 feet and may extend for hundreds of miles in a variety of directions. The initial cost of installation can be as much as $2,000.00 per linear foot, and therefore, to make such a system cost-effective, it is desirable that its useful life be as long as possible, for example, about 100 years or longer.

However, there is a great prevailing problem, in existing systems, of deterioration of the inner walls of the concrete sewer conduits, particularly in the upper region of the pipe interiors where washing of the wall surfaces by the flow of sewage does not take place. The degree of deterioration of the concrete conduits varies from loss of surface cement to total loss of top of the pipe so that the overlying soil collapses into the sewer. Such deterioration has been found to be caused by certain bacteria which are commonplace in sewer systems. The bacteria, which collect and colonize on unwashed interior wall surfaces, take in hydrogen sulfide and oxygen and convert it to sulfuric acid ($H_2SO_4$), which causes erosion of the wall surface on which the bacteria have collected. While the deterioration of such wall surfaces is a very slow process, the degree of deterioration of concrete sewer conduits is such that within 30 to 50 years after installation, such systems require major repairs or replacement of significant lengths of the conduits.

OBJECTS AND SUMMARY OF THE INVENTION

It is therefore a primary object of the present invention to provide a process for flushing away acid from the interior wall surfaces of sewer conduits not normally washed by the flow of sewerage.

Another object of the present invention is to prolong indefinitely the useful life of concrete sewer conduits by preventing the formation of deterioration-causing bacterial colonies on interior wall surfaces of the conduits normally unwashed by the flow of sewerage.

Another object of the present invention is to provide a method and apparatus for periodically applying a cleansing solution to ordinarily unwashed interior surface of concrete sewer conduits.

Still another object of the present invention is to provide a procedure for effecting a permanent installation of apparatus which will minimize the formation of colonies of acid-producing bacteria on the interior walls of sewer conduits.

Still another object of the invention is to provide a method and an apparatus for modifying an already installed concrete sewer system such that the interior walls of the concrete conduits, which during the course of utilization of the system are ordinarily not washed by the flow of sewerage therein, can be subjected to a periodic or continuous flushing to effectively prevent the formation of concrete-deteriorating acid and/or bacterial colonies.

BRIEF DESCRIPTION OF THE DRAWINGS

The invention will be better understood, and objects other than those set forth above will become apparent, when consideration is given to the following detailed description, which makes reference to the annexed drawings wherein.

DETAILED DESCRIPTION OF THE INVENTION

Figure 1:
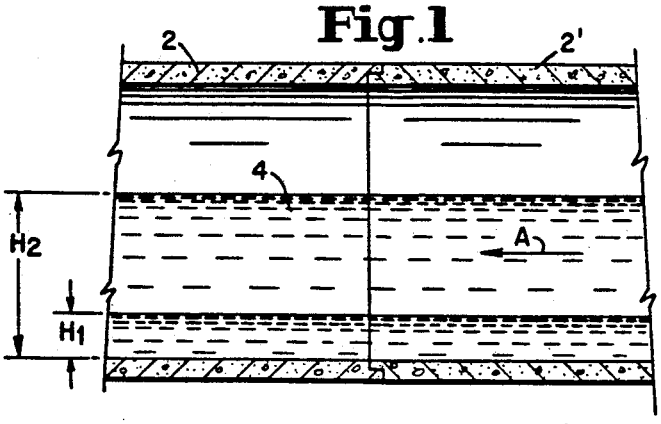
FIGS. 1 and 2 are schematic illustrations of a typical sewer conduit and the fluctuations in depth of sewerage flowing therethrough.

In the following detailed description of FIGS. 1–8, identical or similar reference numerals indicate identical or similar features or structural elements, and where possible the same or similar reference numerals have been used consistently in all the drawings.

Figure 2:
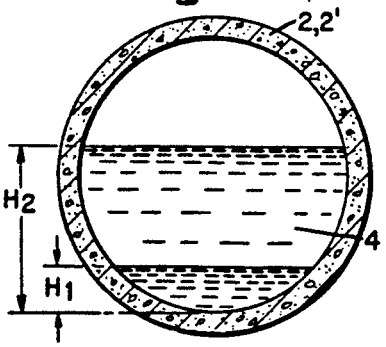

FIGS. 1 and 2 depict, in schematic cross-sectional views, a pair of sewer conduits 2, 2' in a conventional sewer system. The conduits have been installed at a predetermined distance below ground level G and at a predetermined inclination (grading) to insure a desired direction A (and predetermined rate) of through-flow sewerage 4 carried by the conduits. The conduits 2, 2' are typically formed as cylindrical members comprising an admixture of cement and aggregate, with reinforcing elements incorporated into the thickness of the shell wall. A manhole structure 6 preferably is disposed between selected ones of the sewer conduits to facilitate access from a location at ground level, to the interior of the conduits so that routine inspection or maintenance (e.g., cleaning or repair) can be carried out without major excavations.

Ordinarily, in such sewer conduits, the level of sewerage fluctuates between a first height H1 (measured from the floor of the conduits) at a time of day, e.g. the early morning hours, when use of the sewer system is at a minimum, and a second height H2 at a time of day, e.g. the late evening hours, when use of the sewer system is at a maximum. The formation of acid-producing, deterioration-causing bacterial colonies on the inner surface of the conduits located below the first height H1 is effectively prevented by the constant flushing action of the sewerage flowing through the conduits. The formation of such acid on the conduit inner wall surfaces located between the first height H1 and the second height H2 is also effectively diminished by the periodic (usually once per day) flushing of that surface region resulting from the fluctuation in height of the sewerage in the conduits during the course of a day. However, the inner wall surface of the conduits located above the height H2 due to the lack of any flushing action, supports the growth of such bacterial colonies and accumulation of acid and thus suffers deterioration with a consequent reduction in useful life and requirement for repair or replacement of affected conduit segments.

Figure 3:
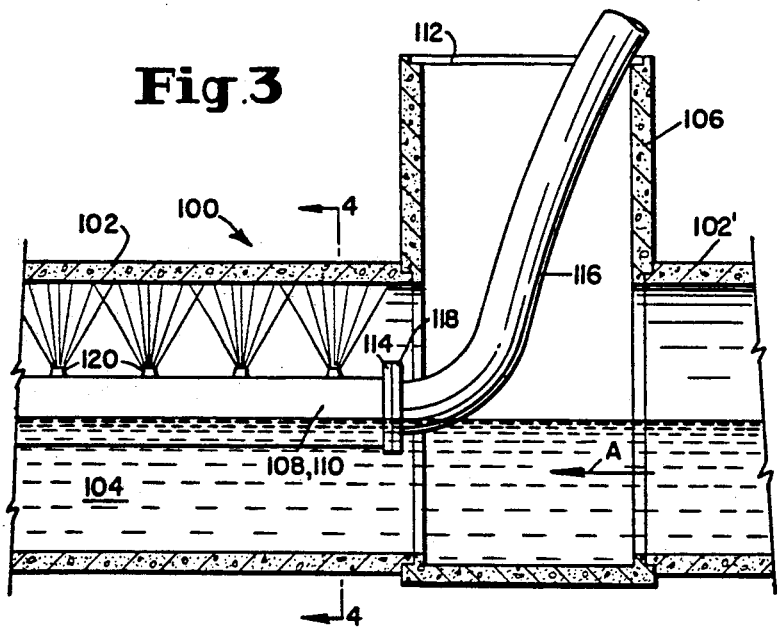
FIG. 3 illustrates a side view of a sewer conduit and a first embodiment of the cleansing apparatus of the present invention.
Figure 4:
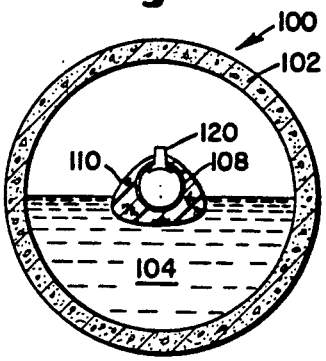
FIG. 4 is a cross-sectional view of the conduit and the cleansing apparatus shown in FIG. 3.

FIGS. 3 and 4 depict a first embodiment 100 of the present invention which is adapted for use in existing, presently functioning sewer systems, and which essentially comprises an elongated hollow pipe 108 encased in a flotation jacket 110. The pipe and its jacket are introduced from the ground level through the manhole 106, into one or more joined sections of sewer conduit 102, such that the longitudinal axis of the pipe, after its introduction, is substantially aligned with the longitudinal axis of the sewer conduit. The flotation jacket is preferably made of a foamed plastic material which floats on the surface of the sewerage flowing in the sewer conduit so that the hollow pipe is also maintained at the surface of the sewerage. The hollow pipe is maintained substantially centrally between opposite sides of the sewer conduit due to laminar flow phenomena of the sewerage in the conduit.

Introduction of the hollow pipe 108 into sections of the sewer conduit is accomplished through the manhole access opening 112 (normally covered by a removable conventional manhole lid, not shown in these Figures). The leading end of the introduced hollow pipe preferably is closed and sealed, while the trailing end of the hollow pipe is connected, via a coupling fixture 114 (including packing means), to a flexible hose 116 having at its forward or leading end a coupling fixture 118 mateable and securable with the pipe coupling fixture 114. The rear end of the flexible hose 116 is connected to, and communicates with, a cleansing fluid supply reservoir (not shown here, but illustrated schematically in FIG. 9 and described in greater detail below). Generally, the connection of the rear end of the flexible hose to the cleansing fluid supply reservoir is made in a conventional manner. The cleansing fluid supply reservoir may, for the purpose of insuring the introduction of cleansing fluid into the flexible hose 116, be coupled with pressurizing apparatus, such as a source of compressed air or a pump, which when operable, delivers the cleansing fluid through the flexible hose 116 to the hollow pipe 108 where it is sprayed, via nozzles 120, onto the upper interior surfaces of sewer conduit 102. The nozzles are disposed in longitudinal alignment along the length of the hollow pipe, preferably at spacings from one another. Such nozzle is secured to the hollow pipe for communication with the interior of the hollow pipe, and projects upwardly from the hollow pipe through an opening in the upper portion of the flotation jacket 110. Upward orientation of the nozzles relative to the hollow pipe 108 is assured by providing the flotation jacket with stabilizing means, as for example, suspending anchors from the flotation jacket, forming the jacket with weights or other anchoring means incorporated into its lower circumferential portion, or forming the jacket with a lower circumferential portion of greater thickness and/or density than the remaining circumferential portions.

Each of the nozzles 120 embodies a spray head which products a spray of cleansing fluid having a fan-like configuration both in a direction parallel to the longitudinal axis of the pipe 108 (as seen in FIG. 3) and in a direction perpendicular to the longitudinal axis of the pipe 108 (as seen in FIG. 4). The particular spray head is chosen with the objective of providing a uniformly thick film of cleansing fluid on the upper, interior "ceiling" region of the sewer conduit 102 at any time of the day (i.e. at the time of maximum sewerage flow in the sewer conduit, at the time of minimum sewerage flow in the conduit, and any time in between) so that the interior "ceiling" region may be subjected to the cleansing fluid whenever it has been determined that the cleansing action should take place, which can take place periodically or continuously during the course of utilization of the sewerage system.

Figure 5:
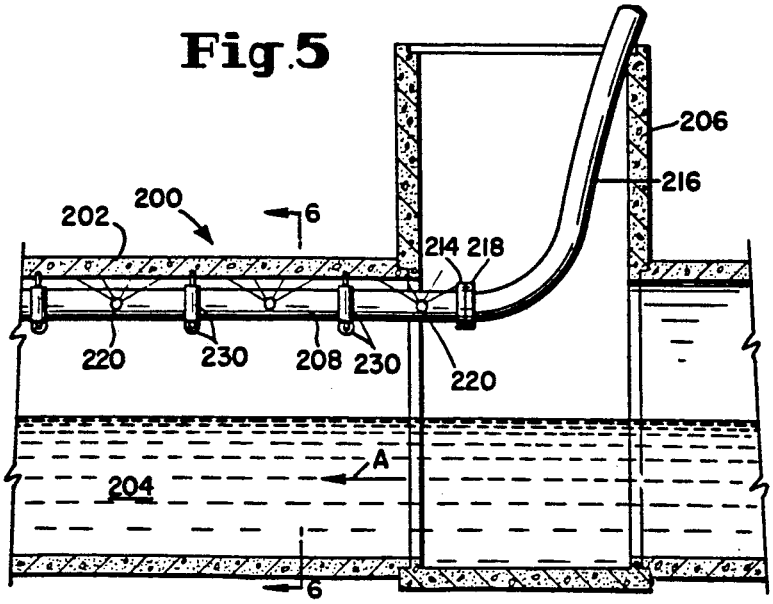
FIG. 5 is a side view of a sewer conduit and a second embodiment of the cleansing apparatus of the present invention.
Figure 6:
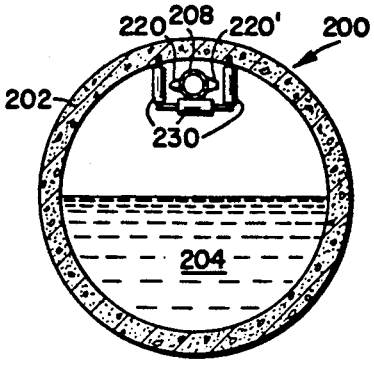
FIG. 6 is a cross-sectional view of the conduit and the cleansing apparatus shown in FIG. 5.

FIGS. 5 and 6 illustrate a second embodiment 200 of a cleansing apparatus which is adapted for permanent installation within a sewer system when the sewer system itself is being installed in the ground. The cleansing apparatus 200 comprises an elongated hollow pipe 208 which is supported by a plurality of brackets attached to the "ceiling" of one or more concrete sewer conduits 202. The brackets are substantially U-shaped and are attached to the conduits in spaced relationship along the longitudinal axis, and two substantially vertical members, extending upwardly from opposite sides of the horizontal member for attachment (in a manner well known in the art) at their uppermost ends to the conduit ceiling. Preferably rollers 230 are carried by the horizontal and vertical members of each bracket, with each roller having an axis of rotation disposed substantially perpendicularly to the respective horizontal or vertical member to which it is attached. The rollers facilitate introduction of pipe 208 through the openings defined between the spaced, aligned U-shaped supporting brackets and the "ceiling" of sewer conduit 202.

Pipe 208 is provided with pairs of spray-forming nozzles 220, 220' disposed at spaced locations along the longitudinal extend thereof. The nozzles in each pair of nozzles 220, 220' are disposed in diametric opposition to each other, and each nozzle of the pair of diametrically opposed nozzles includes a spray head for directing, when the nozzles are substantially horizontally aligned, a spray of the cleansing fluid carried by pipe 208 in a direction which is both upwardly oriented toward the "ceiling" of conduit 202 and substantially parallel to the longitudinal axis of the pipe. Alignment of the pairs of diametrically opposed nozzles in a horizontal plane is preferably accomplished when the pipe is being installed atop the horizontal members of the plurality of spaced, aligned U-shaped brackets, but may also be accomplished by rotating the pipe about its longitudinal axis after such installation.

Once pipe 208 has been installed on the brackets and the nozzles properly aligned, the rearward end of the pipe is coupled to a cleansing fluid supply reservoir including, if desired, means for delivering the cleansing fluid to the pipe under pressure (in a manner similar to the coupling of pipe 108 as shown and described in connection with the embodiment of FIGS. 3 and 4).

Figure 7:
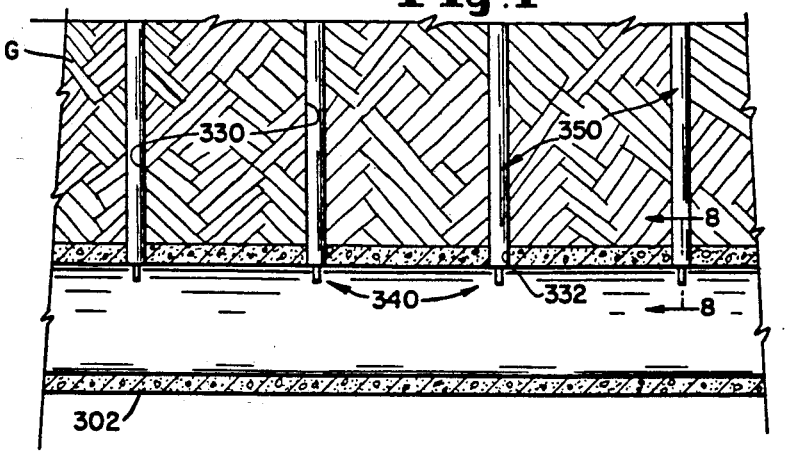
FIG. 7 is a side view of a sewer conduit and a third embodiment of the cleansing apparatus of the present invention.
Figure 8:
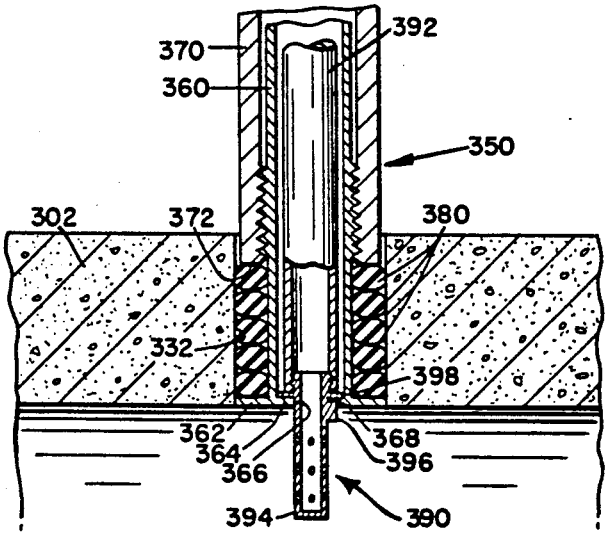
FIG. 8 is a view of the connection of the cleansing apparatus of FIG. 7 to the sewer conduit, shown in greater detail.

FIGS. 7 and 8 illustrate a third embodiment of the cleansing apparatus of the present invention which is particularly suited for installation in an existing, already-buried sewer conduit. In this embodiment, a bore 330 is cut, as for example with a track drill, in the earth at one of a plurality of spaced, predetermined locations atop the sewer conduit 302. Upon encountering the outer surface of conduit 302 at each location, the drilling is continued to form an aperture 332, extending through the "ceiling" or top wall portion of the conduit, within which spray nozzle 340 will be secured.

After the aperture 332 is formed, a casing assembly 350 is inserted through the bore and into the aperture. Casing assembly 350 includes an inner tubular casing 360, an outer tubular casing 370 and a plurality of compression rings 380 disposed about the outer peripheral surface of the inner tubular casing at the lower end thereof. The inner tubular casing is formed, at its lowermost end with a bottom flange having a radially outwardly extending annular portion 362 and a radially inwardly extending annular portion 364. The inwardly extending annular portion is provided with a centrally located opening 366 having a key slot 368. The outwardly extending annular portion is disposed beneath the bottom surface 372 of the outer tubular casing, and the plurality of compression rings are stacked between the upper surface of the outwardly extending annular portion and the bottom surface of the outer tubular casing. The compression rings 380 are preferably made of an elastomeric material, such as rubber.

After the casing assembly is positioned in the conduit aperture 332, the outer tubular casing is moved downwardly relative to the inner tubular casing (via, e.g. a threaded connection between the two casings) so that an axial load is applied to the stack of compression rings. Under the applied axial load, each of the rings expand radially to engage the inner peripheral wall surface of aperture 332 as well as the outer peripheral wall surface of the inner tubular casing 360. In this way, the casing assembly 350 is simultaneously secured and sealed within the aperture 332. It is to be understood that the mechanism for achieving relative movement between the inner and outer tubular casings can be embodied as a threaded connection between the two members with either one of the inner or outer tubular casing being fixed and the other being movable. Further, it is contemplated that the compression rings may be carried by either of the tubular casings, and that the threaded connection may be embodied between the inner and outer tubular casings at any location along the length thereof.

Once the casing assembly has been secured in the aperture 332, nozzle assembly 390 is secured in the centrally located opening 366 in the bottom flange of the inner tubular casing. The nozzle assembly includes a fluid conveying pipe 392 and a nozzle 394 having an outer diameter configured for passage through the opening 366 and a key 396 configured for engagement in the key slot 368. The forward end of the nozzle includes a spray head having spray openings for directing a spray of fluid carried by the pipe 392 upwardly onto the inner wall surface of the sewer conduit ceiling, while the rearward end of the nozzle is provided with a connection portion 398 for connecting the nozzle to the fluid-conveying pipe 392. The nozzle connection portion is configured as an annular flange which engages with the upper surface of the annular portion 364 of the inner tubular casing bottom flange. The flanged connection portion of the nozzle insures that the nozzle spray head is inserted an appropriate predetermined distance from the ceiling of the sewer conduit, and the nozzle key assists in orienting the spray which emanates from the nozzle spray head against the inner wall surfaces of the conduit ceiling in accordance with a predetermined manner.

Figure 9:
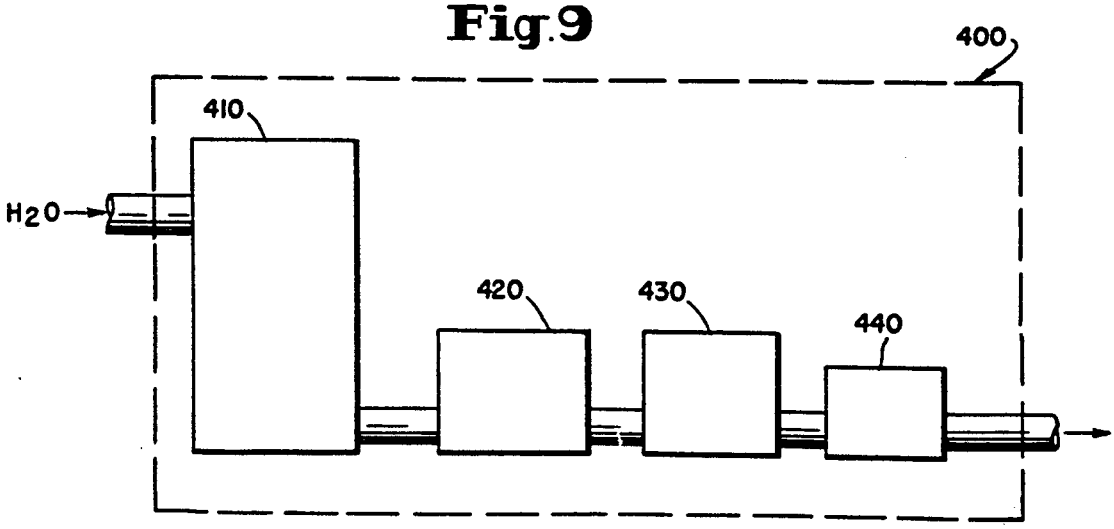
FIG. 9 is a schematic representation of a cleansing fluid reservoir.

FIG. 9 schematically illustrates the cleansing fluid supply system 400 to which the flexible hoses of the first two embodiments (shown in FIGS. 3–4 and 5–6, respectively) and the fluid-conveying pipe of the third embodiment (shown in FIGS. 7–8) are connected. The principal (or the sole, if deemed adequate) fluid component is water, and as shown in FIG. 9, this component may be introduced into a storage reservoir 410 from, or alternatively used directly from, a regional water supply (city or county owned, for example). A booster pump 420 may optionally be provided if it is determined that the water pressure from the regional water supply is less than the pressure required for the particular cleansing apparatus chosen. For example, the embodiments of FIGS. 3–6 require a pressure of at least 30–50 pounds while the embodiment of FIGS. 7–8 requires a greater amount of water pressure, and consequently booster pump 420 would ordinarily be employed when the cleansing apparatus of FIGS. 7–8 is being used.

Additionally, the cleansing fluid supply system 400 may include (or be coupled with) a chemical feed pump 430. While ordinary water may be adequate in many cases, it may be desirable to add chemicals of various kinds to accomplish particular results For example, it might be desirable to adjust the alkalinity of a solution so that when the interior wall surfaces of the sewer conduit are wetted, they possess non-acidic characteristics for a longer period of time than with wetting by ordinary water, thereby neutralizing the effects of any acid-forming bacteria which could collect between washings.

Alternatively (or in addition), a bacteriacide, such as sodium hypochloride or a chlorine solution, could be added via chemical feed pump 430 to kill the bacteria that manufactures the acid and thus prolong the period otherwise required between wettings of the surfaces of the sewer conduit interior wall.

Finally, filter means and/or heating means (shown at 440) may be used to filter any foreign material out of the cleansing fluid before it reaches the spray-forming nozzles, and/or to preheat the cleansing fluid (as for example, to a steam), respectively.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method of cleansing away concrete deteriorating acid from interior wall surfaces of concrete sewer conduit, in a sewerage system, normally unwashed by a flow of sewerage therethrough, comprising: introducing a plurality of spray-forming nozzle means into and spaced-apart along said concrete sewer conduit; orienting said nozzle means within said sewer conduit such that spray formed by cleansing fluid passing from said nozzle means will contact and wash said normally unwashed interior wall surfaces of said concrete conduit;

connecting said nozzle means via tubular means to a pressurized source of cleansing fluid; and thereby causing said cleansing fluid to flow to said nozzle means; leaving said nozzle means within said concrete sewer conduit a sufficient period of time to enable a spraying operation of cleansing fluid from said nozzles, which can be a continuous operation, during the course of utilization of said concrete sewer conduit in the sewerage system; whereby a spray of said cleansing fluid formed by said nozzle means will wash from said interior wall surfaces concrete deteriorating acid introduced by any means including acid forming bacteria thereby prolonging the useful life of said concrete sewer conduit.

2. The method of claim 1, wherein said step of introducing said nozzle means into said conduit comprises supporting said nozzle means above the flow of sewerage in said conduit.

3. The method of claim 2, wherein said supporting step comprises securing said nozzle means to said sewer conduit in close proximity to an uppermost region of said interior wall surfaces.

4. The method of claim 1, wherein said introducing step comprises securing said nozzle means to said sewer conduit in close proximity to an uppermost region of said interior wall surfaces.

5. The method of claim 1, wherein said introducing step comprises providing said nozzle means and said tubular means with a flotation jacket and disposing said jacketed tubular means on the surface of said flow of sewerage with the nozzle means above the flow of sewerage.

6. The method of claim 1, wherein said step of introducing comprises for each nozzle means:

cutting an aperture in an upper region of said concrete sewer conduit, passing a forward portion of said nozzle means downwardly through said aperture, and securing a rearward portion of said nozzle means within said aperture.

7. The method of claim 1, wherein said step of causing said cleansing fluid to flow to said nozzle means comprises interrupting the flow of said fluid for predetermined intervals.

8. A method of cleansing interior wall surfaces of concrete sewer conduit normally unwashed by the flow of sewerage therethrough while said sewer conduit is in use in a sewerage system, comprising: introducing a cleansing fluid into said sewer conduit; and applying said introduced cleansing fluid to said normally unwashed interior wall surfaces during the course of utilization of said concrete conduit in a sewerage system, which if desired can be continuous.

9. The method of claim 8, wherein said step of applying comprises flushing said interior wall surfaces with said cleansing fluid.

10. The method of claim 9, wherein said step of flushing said interior wall surfaces comprises periodically bathing said wall surfaces with said cleansing fluid during the course of utilization of said sewerage system.

11. The method of claim 8, wherein said step of introducing said cleansing fluid comprises first pressurizing said cleansing fluid.

12. The method of claim 9, wherein said step of introducing said cleansing fluid comprises first pressurizing said cleansing fluid.

13. The method of claim 8, wherein said step of introducing said cleansing fluid comprises first heating said cleansing fluid.

14. The method of claim 9, wherein said step of introducing said cleansing fluid comprises first heating said cleansing fluid.

15. The method of claim 9, wherein said step of flushing comprises spraying said cleansing fluid onto said normally unwashed concrete sewer conduit wall surfaces.

16. The method of claim 8, wherein said step of introducing said cleansing fluid comprising inserting a plurality of nozzle means into and at spaced-apart intervals along said sewer conduit and coupling said nozzle means with a source of said cleansing fluid.

17. The method of claim 16, wherein said step of introducing said cleansing fluid further comprises supporting said plurality of nozzle means above the surface of the flow of sewerage in said sewer conduit.

18. The method of claim 17, wherein said step of supporting comprises suspending said plurality of nozzle means from the interior wall surfaces above said surface of the flow of sewerage.

19. The method of claim 17, wherein said step of supporting comprises encasing said nozzle means in a floatable jacket adapted to float on the surface of with said nozzle means above said flow of sewerage.

20. A method of cleansing away concrete deteriorating acid from interior wall surfaces of concrete sewer conduit in a sewerage system normally unwashed by a flow of sewerage therethrough, comprising: introducing tubular means, with a plurality of spray-forming nozzle means spaced-apart therealong, into said concrete sewer conduit for conveying cleansing fluid into said sewerage system; orienting said nozzle means within said conduit such that spray formed by cleansing fluid passing from said tubular means through said nozzle means will contact and wash said normally unwashed interior wall surfaces of said concrete conduit; connecting said tubular means to a pressurized source of cleansing fluid, and thereby causing said cleansing fluid to flow to and from said nozzle means; leaving said tubular means, with said nozzle means, within said concrete sewer conduit a sufficient period of time to enable a spraying operation of cleansing fluid from said nozzles, which can be a continuous operation, during the course of utilization of said concrete sewer conduit in the sewerage system; whereby a spray of said cleansing fluid formed by said nozzle means will wash from said interior wall surfaces concrete deteriorating acid introduced by any means including acid forming bacteria thereby prolonging the useful life of said concrete sewer conduit.

21. The method of claim 20, wherein said step of introducing said tubular means with said nozzle means into said conduit comprises supporting said tubular means with said nozzle means located above the flow of sewerage in said conduit.

22. The method of claim 21, wherein said supporting step comprises securing said tubular means with said nozzle means to said sewer conduit in close proximity to an uppermost region of said interior concrete conduit wall surfaces.

23. The method of claim 20, wherein said introducing step comprises securing said nozzle means to said sewer conduit in close proximity to an upper most region of said concrete conduit interior wall surfaces.

* * * * *

UNITED STATES PATENT AND TRADEMARK OFFICE

CERTIFICATE OF CORRECTION

PATENT NO. : 5,009,715

DATED : April 23, 1991

INVENTOR(S) : R. E. WILSON

It is certified that error appears in the above-identified patent and that said Letters Patent is hereby corrected as shown below:

ON THE TITLE PAGE:

Please change the Inventor's address (item 76) to

--1175 East Ocean Blvd.,
Apt. 306
Long Beach, California 90802--.

In the second column, please correct the spelling of the attorney's firm name to --NIES, KURZ, BERGERT & TAMBURRO--.

Column 1, line 6, change "4,299,770" to --4,899,770--.

Signed and Sealed this

Twenty-fifth Day of August, 1992

*Attest:*

DOUGLAS B. COMER

*Attesting Officer*

*Acting Commissioner of Patents and Trademarks*